United States Patent [19]

Webb et al.

[11] Patent Number: 4,759,157

[45] **Date of Patent: * Jul. 26, 1988**

[54] ROOF EDGE CONSTRUCTION

[75] Inventors: Russell Webb, Woodfin; John B. Hickman, Biltmore Forest, both of N.C.

[73] Assignee: W. P. Hickman Company, Asheville, N.C.

[ * ] Notice: The portion of the term of this patent subsequent to Feb. 10, 2004 has been disclaimed.

[21] Appl. No.: 11,921

[22] Filed: Feb. 6, 1987

Related U.S. Application Data

[63] Continuation-in-part of Ser. No. 733,641, May 13, 1985, Pat. No. 4,641,476.

[51] Int. Cl.[4] ..... E04D 1/36

[52] U.S. Cl. ..... 52/60; 52/94

[58] Field of Search ..... 52/60, 94, 95, 96, 97, 52/300, 573, 466, 469, 717, 718

[56] References Cited

U.S. PATENT DOCUMENTS

| | | |
|---|---|---|
| Re. 26,056 | 7/1966 | Hickman . |
| Re. 27,761 | 9/1973 | Attaway . |
| B14,071,987 | 7/1984 | Hickman . |
| 164,602 | 6/1875 | Shepard . |
| 674,379 | 5/1901 | Hard . |
| 1,299,425 | 4/1919 | Carpenter . |
| 1,337,840 | 4/1920 | Hawley . |
| 1,740,753 | 12/1929 | Vallas . |
| 1,782,246 | 11/1930 | Schneider . |
| 2,136,122 | 11/1938 | Almdale . |
| 2,160,758 | 5/1939 | Schurman . |
| 2,219,992 | 10/1940 | Hanson . |
| 2,250,548 | 7/1941 | Ness . |
| 2,554,779 | 5/1951 | Goodwin . |
| 2,734,602 | 2/1956 | Dawson . |
| 2,755,484 | 7/1956 | Hotz . |
| 2,793,403 | 5/1957 | Livingston . |
| 2,855,776 | 10/1958 | Trostle . |
| 2,857,861 | 10/1958 | Trostle . |
| 2,920,477 | 1/1960 | Shaw . |
| 3,012,376 | 12/1961 | Reddy et al. . |
| 3,024,573 | 3/1962 | McKinley . |
| 3,090,161 | 5/1963 | Edwards . |
| 3,237,352 | 3/1966 | Edwards . |
| 3,389,515 | 6/1968 | Hellebrand . |
| 3,405,485 | 10/1968 | Edwards . |
| 3,415,020 | 12/1968 | Windle . |

(List continued on next page.)

FOREIGN PATENT DOCUMENTS

| | | |
|---|---|---|
| 603078 | 8/1960 | Canada . |
| 1509147 | 11/1969 | Fed. Rep. of Germany . |
| 1918761 | 10/1970 | Fed. Rep. of Germany . |
| 1659340 | 1/1971 | Fed. Rep. of Germany . |
| 1933004 | 1/1971 | Fed. Rep. of Germany . |
| 2060292 | 6/1972 | Fed. Rep. of Germany . |
| 2118981 | 10/1972 | Fed. Rep. of Germany . |
| 2234975 | 2/1974 | Fed. Rep. of Germany . |
| 2316266 | 10/1974 | Fed. Rep. of Germany . |
| 2335223 | 1/1975 | Fed. Rep. of Germany . |
| 1128360 | 8/1956 | France . |
| 7610357 | 4/1977 | Netherlands . |
| 7432 | of 1911 | United Kingdom . |
| 1024071 | 3/1966 | United Kingdom . |
| 1104027 | 2/1968 | United Kingdom . |
| 1180965 | 2/1970 | United Kingdom . |
| 1203344 | 8/1970 | United Kingdom . |
| 1347974 | 2/1974 | United Kingdom . |
| 2084628 | 4/1982 | United Kingdom . |

OTHER PUBLICATIONS

Pomar Building Products, Inc. introduces Hilite Fascia, (1 page).

W. P. Hickman Co., "Hickman Aluminum Construction Products"–1980–16 pages.

(List continued on next page.)

*Primary Examiner*—David A. Scherbel

*Assistant Examiner*—Creighton Smith

*Attorney, Agent, or Firm*—Harness, Dickey & Pierce

[57] ABSTRACT

An assembly is disclosed for forming a raised roof edge on a building structure that preferably has a generally horizontal roof and a generally vertical outer face. The assembly includes a dam member for forming a water dam or gravel stop, a fascia member, and a separate clip member interposed therebetween for resiliently biasing the fascia member into a relatively tight and rattle-free interlocking installation on the dam member. Preferably, a roofing material is interposed between the clip member and the dam member and is frictionally secured and anchored therebetween as a result of the resilient snap-on engagement of the fascia member on the clip member and the dam member. The roof edge assembly thereby provides an improved water dam or gravel stop structure that securely retains and protects the roofing material on the roof of the building structure.

42 Claims, 5 Drawing Sheets

U.S. PATENT DOCUMENTS 3,444,658 5/1969 Gobel .
3,477,273 6/1969 Thom .
3,488,902 1/1970 Gobel .
3,503,162 3/1970 Ward .
3,529,653 9/1970 Fey .
3,533,201 10/1970 Tyler .
3,571,992 3/1971 Comiskey .
3,608,255 9/1971 Chomes .
3,624,973 12/1971 Attaway .
3,668,811 6/1972 Pollard .
3,680,269 8/1972 Fischer, Jr. et al. .
3,696,575 10/1972 Armstrong .
3,712,003 1/1973 Hallock et al. .
3,719,010 3/1973 Hickman .
3,731,439 5/1973 Hickman .
3,735,540 5/1973 Thaler .
3,738,068 6/1973 Attaway .
3,742,668 7/1973 Oliver .
3,802,140 4/1974 Hickman .
3,812,634 5/1974 Resech .
4,037,372 7/1977 Patry .
4,067,152 1/1978 Wolma .
4,071,987 2/1978 Hickman .
4,132,390 1/1979 Pfarr, Jr. .
4,155,203 5/1979 Wolma .
4,231,141 11/1980 Derrick et al. .
4,241,549 12/1980 Hall, III et al. .
4,404,777 9/1983 Lolley et al. .
4,419,850 12/1983 Butzen .
4,439,956 4/1984 House .
4,472,913 9/1984 Hickman .
4,483,112 11/1984 Rueblinger .
4,488,384 12/1984 Hickman .
4,549,376 10/1985 Hickman .
4,586,301 5/1986 Hickman .
4,641,147 2/1987 Webb et al. .
4,662,129 5/1987 Hickman .

OTHER PUBLICATIONS

Braas-PVC Flat-Roof Systems (9 pages).
Technique+Detail—Purpose-Made Accessories for Braas Flat Roofs, BRAAS (10 pages).
Master-Edge Extruded Aluminum Fascia: "The Ultimate in Perimeter Roof Construction"—(1 page).
Type JJ—Alcoa (1 page).
"Drip-Proof Fascia and Cant Dam Systems"—MM Systems Corporation (1 page).
Loss Prevention Data—Apr. 1983—Factory Mutual System (20 pages).
Hickman Construction Products—1986 (20 pages).
Fascia Systems—MM Systems Corporation Catalog No. 24F (16 pages).
Design NP-Carlisle SynTech Systems-4 pages.

FIG. 9.
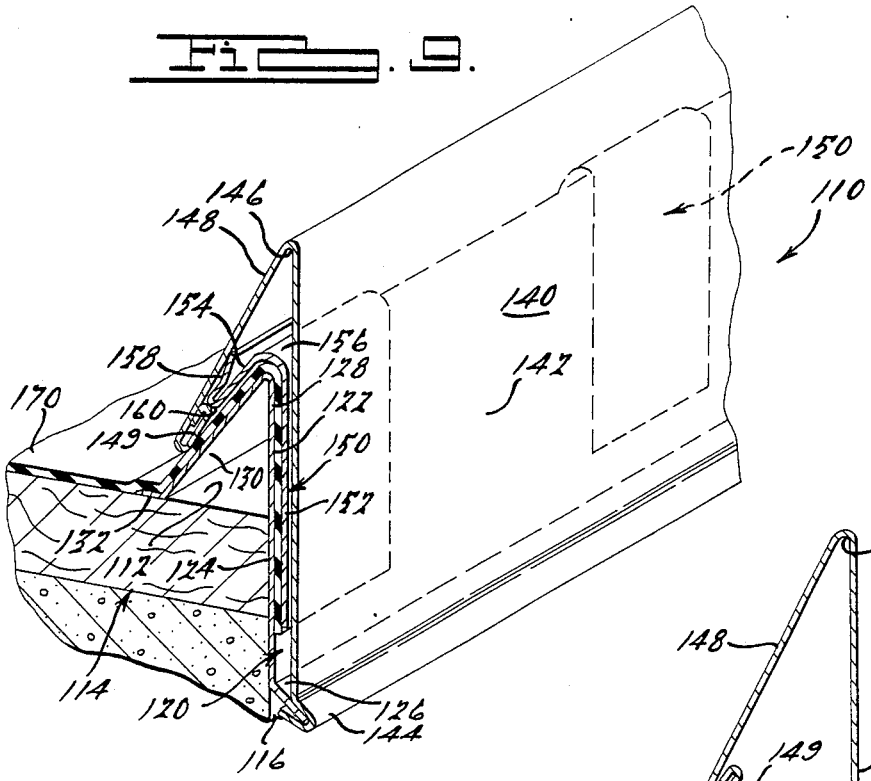
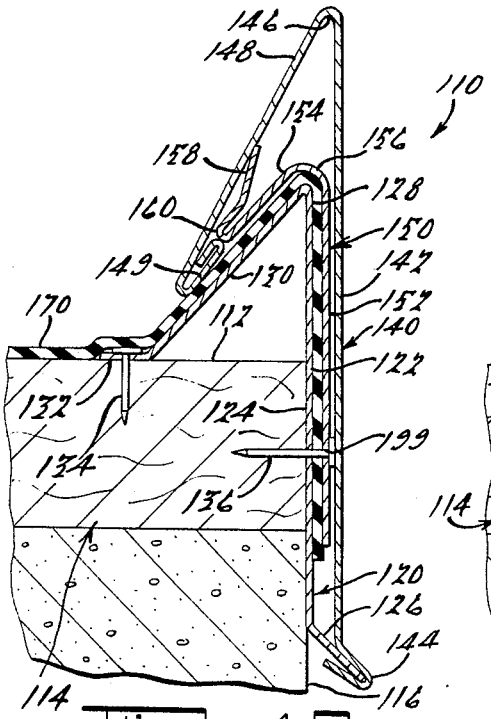
FIG. 10.
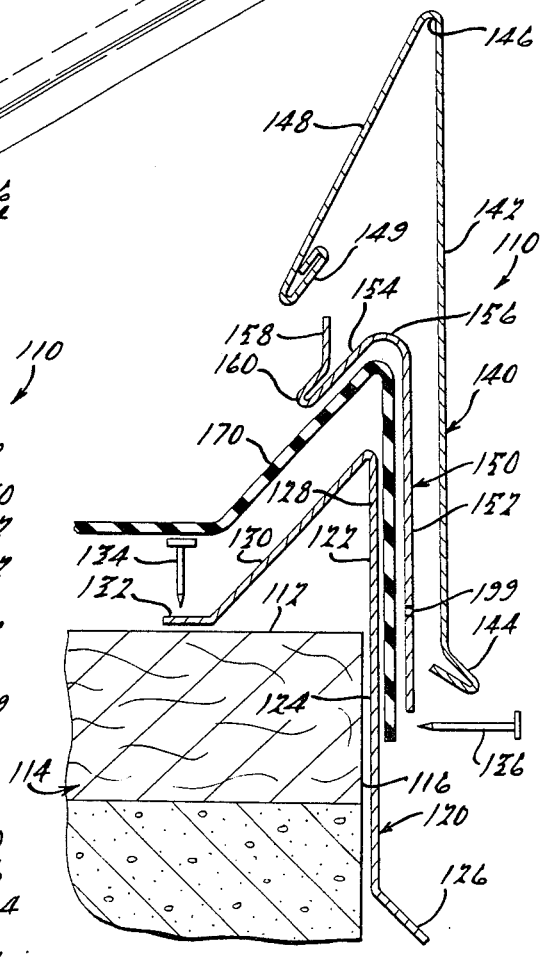
FIG. 11.

Fig. 15.
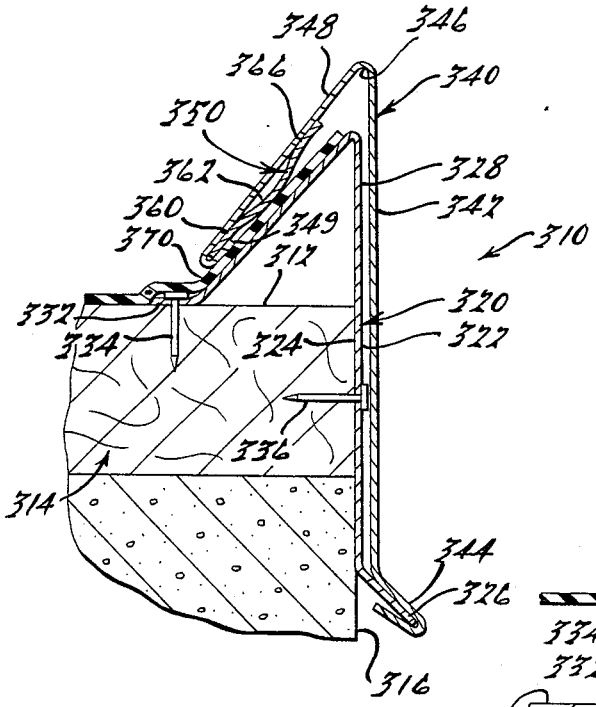
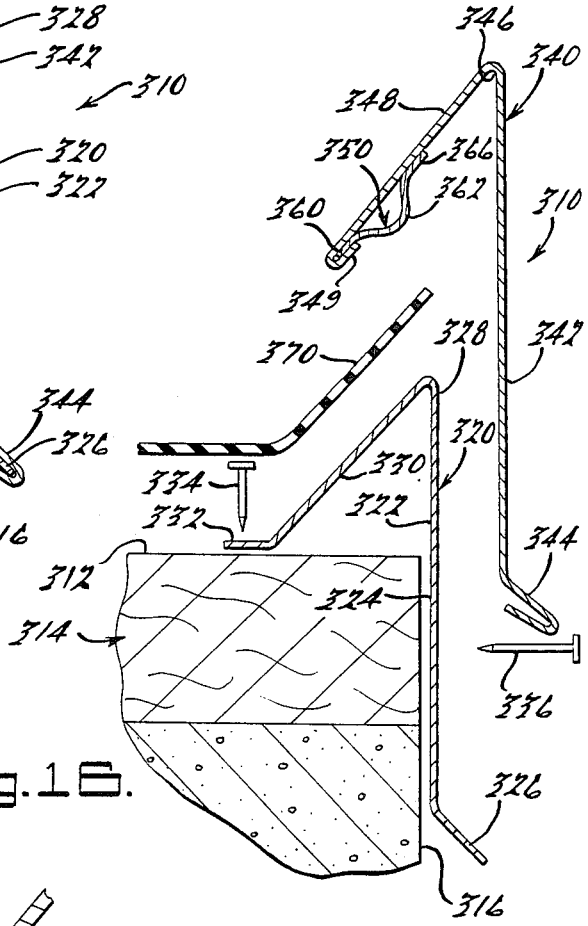
Fig. 16.
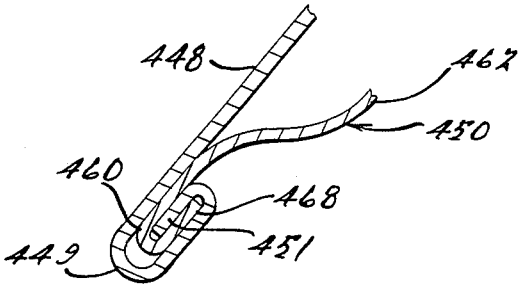
Fig. 17.

ROOF EDGE CONSTRUCTION

BACKGROUND AND SUMMARY OF THE INVENTION

This is a continuation-in-part of a copending application for U.S. patent Ser. No. 733,641, filed May 13, 1985 now U.S. Pat. No. 4,641,476, entitled ROOF EDGE CONSTRUCTION, and naming Russell Webb and John B. Hickman as inventors. Such copending application will issue as U.S. Pat. No. 4,641,476 on Feb. 10, 1987, and the disclosure of which is hereby incorporated by reference herein.

The invention relates generally to building structures and more particularly to raise roof edge constructions for such building structures.

Various raised roof edge assemblies, gravel stop assemblies, water dams, and the like, have been provided for purposes of anchoring a sheet-like roofing membrane, retaining gravel ballast or other roofing materials for controlling water drainage, and for supporting a fascia member at the edge of the roof of a building structure. Some examples of such previous roof edge assemblies are disclosed in U.S. Pat. Nos. 3,719,010; Re. 26,056; 4,071,987; 4,472,913; 4,488,384; and 4,549,376, the references cited therein, and in copending U.S. application Ser. No. 830,463, filed Feb. 18, 1986, entitled ROOF EDGE CONSTRUCTION WITH COMPRESSION AND FLASHING MEMBERS. The disclosures of these patents and this application are also hereby incorporated herein by reference.

The inventions disclosed in the above-referenced patents and application represent great strides over previous roof edge constructions in terms of simplicity, cost effectiveness, ease of installation, and effectiveness in anchoring roofing membranes. It has been found in many instances, however, that it is desirable to even further increase the weather protection for, and anchoring engagement of, a roofing material at the edge of a building structure. Therefore, the present invention seeks to provide such further increased protection, anchoring and holding power of the roofing material in a spring-action or snap-on type fascia mounting and supporting assembly that also forms a raised roof edge or gravel stop at the outer edge of the roof structure. The invention further addresses itself to increasing both the simplicity of the components involved in the assembly and the ease of their installation.

According to the present invention, an assembly is provided for forming a raised roof edge on a building structure that has a generally vertical outer face. The roof edge assembly according to the present invention includes a dam member with a vertical dam portion having an inwardly directed face for confronting the outer face of the building structure. The vertical dam portion includes an upper dam portion and a lower dam portion, with attachment means for attaching the vertical dam portion to the outer face of the building structure with the upper dam portion protruding upwardly above the roof and preferably including a generally inwardly and downwardly sloping dam portion extending therefrom.

A fascia member, having a vertical fascia portion and an upper sloping portion, is securely installable on the dam member and preferably includes a generally concave upper portion (formed by the vertical portion and the upper sloping portion) for receiving the upper dam portion therein, as well as a lower channel portion (adjacent the lower end of the vertical portion) for receiving the lower dam edge portion therein, when the fascia member is securely installed on the dam member. An inner portion of the fascia member protrudes or extends generally into the concave upper portion, preferably from the upper sloping portion, to confront and engage the above-mentioned sloping dam portion.

A clip member is provided in the above-described roof edge assembly for interposition between the fascia member and the dam member, with all or at least a portion of the clip member being adapted for interposition between the sloping portions of the fascia and dam members, when the fascia member is securely installed thereon. In some preferred embodiments, the clip member has a generally vertical clip portion that is positionable in a generally confronting relationship with the vertical dam portion, a sloping clip portion (preferably at or near the top of the vertical clip portion) extending generally downwardly and inwardly relative to the vertical dam portion, and a lower clip edge portion on the sloping clip portion.

The clip member in the embodiments discussed above also preferably includes a transverse locking portion that protrudes from, and forms part of, an area generally adjacent the lower clip edge on the sloping clip portion. The locking portion can protrude or extend in a generally outward and upward direction, in a generally inward and upward direction, or in other directions transverse to the sloping clip portion, in order to engage the above-discussed inner portion of the fascia member in a resilient interlocking engagement therewith. This arrangement allows the fascia member to be conveniently and resiliently "snapped" into a secure installation on the dam member, with the clip member therebetween. The clip member in at least some of the embodiments of the invention can be composed of a resilient spring material so that portions of the clip member are resiliently deflected upon installation of the fascia member, thus resulting in reactive biasing forces exerted on the dam member or the fascia member, or both, to aid in the secure retention of the fascia member.

In other preferred embodiments, the vertical clip portion can be eliminated, with the clip member interposed only between the sloping portion of the fascia and the sloping portion of the dam member. In these embodiments, the clip member includes a generally flat lower clip edge portion adapted to be engaged by the above-discussed inner portion of the fascia member and a discontinuity thereon. Such discontinuity, which is preferably a generally arcuate (or otherwise concave) portion, is resiliently compressed to resiliently bias the fascia member into a secure installation on the remainder of the roof edge assembly. The clip member in the other preferred embodiments discussed above can further include a hooked end generally at the lower clip edge portion for interlockingly engaging a similarly hooked end of the inner portion fascia member, and can also include another generally flat clip flange portion adjacent the concave clip portion on the opposite side from the lower clip edge.

The present invention contemplates the use of either a number of discrete clip members interposed between the dam member and the fascia member at spaced-apart locations along the roof edge assembly, or a single clip member that is substantially continuous with each generally straight run or section of the roof edge assembly along the edge of the building structure.

Preferably a sheet-like roofing material overlappingly engages at least a portion of the dam member and is grippingly interposed between the dam member and the clip member. The above-discussed engagement of the fascia member with the clip member, as well as the resilient deflection of the clip member in at least some embodiments of the invention, result in a frictional engagement and anchoring of the roofing material between the dam member and the clip member when the fascia member is securely installed on the remainder of the roof edge assembly. In addition, the above-mentioned inward side of the concave upper fascia portion preferably extends generally downwardly and inwardly toward the roof of the building structure to protect the roofing material from water, wind or other elements, and to provide for an enhanced gripping engagement and anchoring of the roofing material between the dam member and the above-mentioned inner portion of the fascia member.

Additional objects, advantages, and features of the present invention will become apparent from the following description and appended claims, taken in conjunction with the accompanying drawings.

BRIEF DESCRIPTION OF THE DRAWINGS

FIG. 9 is a perspective view similar to that of FIG. 1, but illustrating still another exemplary raised roof edge assembly secured to the top edge of a building according to the present invention.

FIG. 10 is a cross-sectional view of the roof edge assembly of FIG. 9.

FIG. 11 is an exploded cross-sectional view of the roof edge assembly of FIGS. 9 and 10.

FIG. 15 is a cross-sectional view of a further preferred embodiment of a roof edge assembly according to the present invention.

FIG. 16 is an exploded cross-sectional view of the roof edge assembly of FIG. 15.

FIG. 17 is a cross-sectional view of another preferred embodiment similar to that of FIG. 15, but illustrating a further variation thereon.

DETAILED DESCRIPTION OF THE PREFERRED EMBODIMENTS

Figure 1:
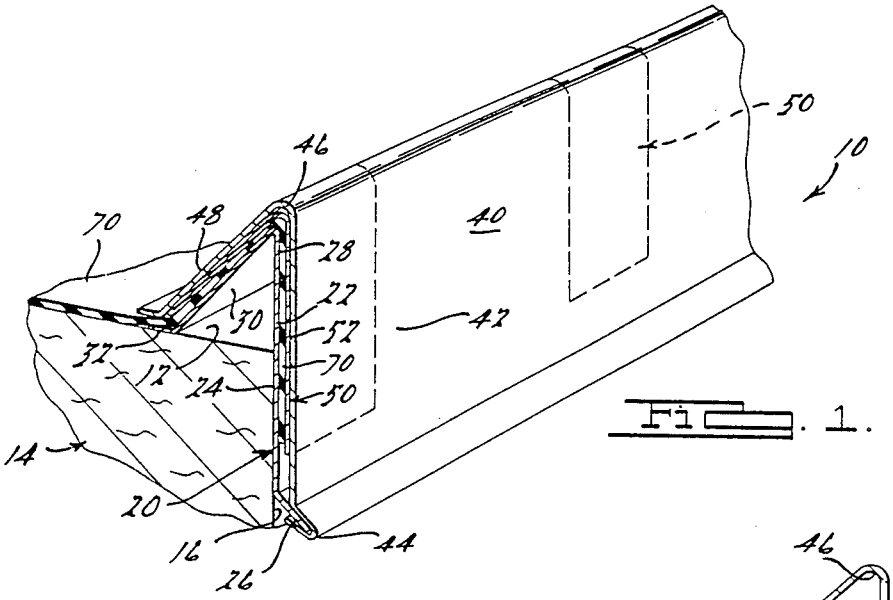
FIG. 1 is a perspective view of an exemplary raised roof edge assembly secured to the top edge of a building in accordance with the present invention.
Figure 2:
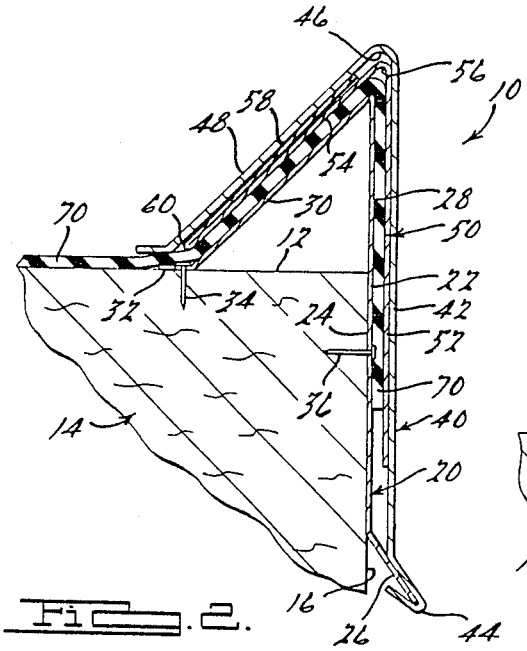
FIG. 2 is a cross-sectional view of the roof edge assembly of FIG. 1.
Figure 3:
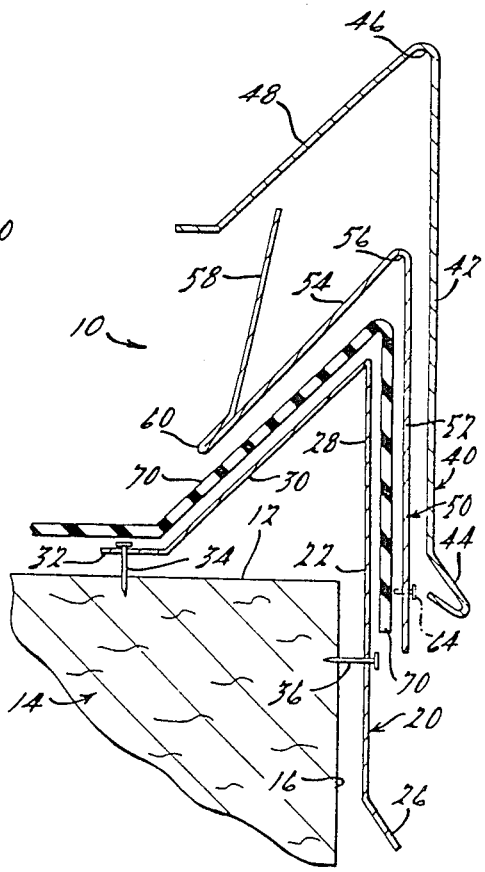
FIG. 3 is an exploded cross-sectional view of the roof edge assembly of FIGS. 1 and 2, illustrating the spring clip member in its free, undeflected state.

FIGS. 1 through 8 illustrate various exemplary embodiments of an assembly for forming a raised roof edge on a building structure in accordance with the present invention, as disclosed and described in the above-mentioned U.S. Pat. No. 4,641,476. FIGS. 9 through 17 illustrate other embodiments of, and variations on, the roof edge assemblies shown in FIGS. 1 through 8. It should be noted, however, that the present invention is applicable in roof edge assemblies other than those shown for purposes of illustration in the drawings, as well as in other applications for forming building edge constructions.

In FIGS. 1 through 4, a preferred raised roof edge assembly 10 for forming a raised gravel stop and water dam on a roof 12 of a building structure 14 generally includes a dam member 20, a fascia member 40, and a spring clip member 50 interposed between the dam member 20 and the fascia member 40. Preferably, and perhaps more commonly in practice, the assembly also includes a portion of a roofing material 70 overlapping engaging the dam member 20 and being grippingly interposed between the dam member 20 and the spring clip member 50.

The preferred dam member 20 includes a generally vertical dam portion 22 having an inwardly directed face 24 positionable in a generally confronting relationship with an outer face 16 of the building structure 14. The vertical dam portion 22 extends generally upwardly from a lower dam edge portion 26 to an upper dam portion 28 disposed above the roof 12 of the building structure 14 when the vertical dam portion 22 is positioned in a generally confronting relationship with the outer face 16. The dam member 20 preferably also includes a sloping dam portion 30 extending generally downwardly and inwardly from the top of the upper dam portion 28 to engage the roof 12 of the building structure 14. A flange 32, which is preferably provided at the lower edge of the sloping dam portion 30, is secured to the building structure by a roofing nail or other suitable fastener 34 for attaching the sloping dam portion 30 to the roof 12. Likewise, a similar fastener 36 is preferably provided for attaching the vertical dam portion 22 to the outer face 16 of the building structure 14. In order to securely and interlockingly install the fascia member 40 on the dam member 20 in a manner to be described below, the lower dam edge portion 26 can advantageously be bent or otherwise formed in a generally downwardly and outwardly extending direction.

The preferred fascia member 40 is formed of a sheet material, such as sheet metal for example, and includes a generally vertical fascia portion 42 extending between a lower channel portion 44 and a generally concave upper portion 46 formed at the intersection of the vertical fascia portion 42 and a sloping fascia portion 48 that extends in a generally downward and inward direction relative to the vertical fascia portion 42. As is illustrated in FIGS. 1 through 4, the concave upper portion 46 receives and overlappingly engages the sloping dam portion 30, and the lower channel portion 44 receives the lower dam edge portion 26 therein when the fascia member 40 is securely and interlockingly installed on the dam member 20.

The separate spring clip member 50 is interposed between the fascia member 40 and the dam member 20 when the fascia member 40 is securely installed in place, and is preferably formed from a sheet-like spring material, such as spring steel sheet for example. The preferred spring clip member 50 has a generally vertical spring clip portion 52 positionable in a generally confronting relationship with the vertical dam portion 22. A first sloping portion 54 of the spring clip member extends in a generally downward and inward direction from the top of the upper dam portion 28 when the spring clip member is positioned on the dam member 20 and forms a generally concave upper spring clip portion 56 with the vertical spring clip portion 52. The preferred spring clip member 50 further includes a second sloping portion 58 extending in a generally upward and preferably outward direction from a lower spring clip edge portion 60 to form a generally acute angle with the first sloping portion 54.

Although it is preferred that the entire spring clip member 50 is resiliently deflectable, at least the second sloping portion 58 is resiliently and pivotally deflectable relative to the lower spring clip portion 60 in a direction toward the first sloping portion 54 when the fascia member 40 is securely installed on the dam member 20 with the spring clip member 50 interposed therebetween. A fastener 64 can optionally be included in order to secure or attach the vertical spring clip portion 52 to the outer face 16 of the building structure 14, through the vertical dam portion 22. Such optional fastener 64 is discussed in more detail below, in connection with FIG. 8.

The roofing material 70 is preferably a flexible sheet-like material, which may be a resilient plastic, a resilient rubber or other elastomeric material, tar paper, roofing felt, or other suitable roofing materials known to those skilled in the art. The roofing material 70 flatly engages the upper surface of the roof 12 and includes a portion thereof interposed between at least the sloping dam portion 30 and the first sloping portion 54 of the spring clip member 50. Preferably, however, the roofing material 70 extends outwardly and then downwardly to also overlappingly engage the vertical dam portion 22 to be grippingly engaged between the vertical cam portion 22 and the vertical spring clip portion 52. As is described more fully below, the fascia member 40 is interlockingly and securely installed on the dam member 20, with the spring clip member 50 interposed therebetween, in order to frictionally anchor and secure the roofing material 70 between the spring clip member 50 and the dam member 20.

Figure 4:
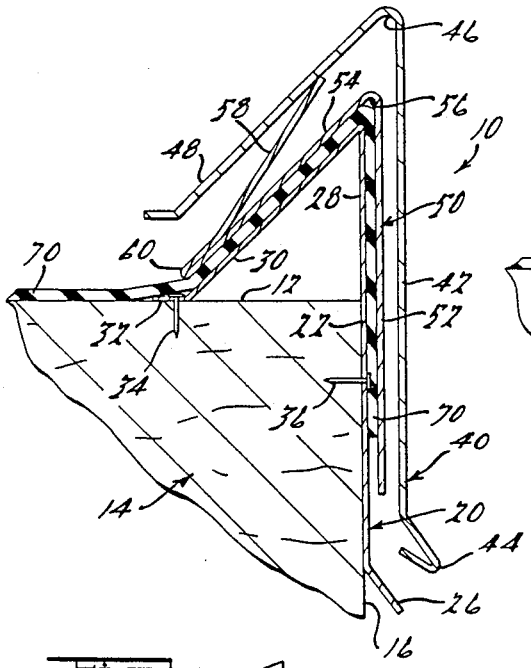
FIG. 4 is a cross-sectional view similar to FIG. 2, but illustrating the fascia member being installed on the remainder of the roof edge assembly.

FIG. 4 illustrates the manner in which the fascia member 40 is interlockingly installed on the remainder of the raised roof edge assembly 10. Once the dam member 20 is securely attached to the building structure 14, and the roofing material 70 is properly positioned in an overlapping engagement on the dam member 20, the spring clip member 50 is positioned over the roofing material 70 and the dam member 20 and is optionally secured to the building structure 14 by the fastener 64. The concave upper portion 46 of the fascia member 40 is placed over the spring clip member 50 and urged downwardly so as to resiliently deflect or collapse at least the second sloping portion 58 of the spring clip member 50. Such deflection of the second sloping portion 58 allows the lower channel portion 44 of the fascia member 40 to clear the lower dam edge portion 26. Thereafter, the fascia member 40 is released and the resilient nature of the spring clip member 50 causes the fascia member 40 to spring or snap upwardly such that the lower channel portion 44 interlockingly receives the lower dam edge portion 26 and is captured thereon. In this manner, the fascia member 40 is resiliently and removably attached to the dam member 20 in a generally tight and rattle-free secure installation thereon. Such relatively tight installation of the fascia member 40 on the remainder of the raised roof edge assembly 10 results in a relatively tight frictional securement of the roofing material 70 between the spring clip member 50 and the dam member 20 as is described in more detail below.

As a result of its resilient deflection, the second sloping portion 58 of the spring clip member 50 exerts a resilient biasing force on the sloping fascia portion 48 and the concave upper portion 46 of the fascia member 40 in a generally upward and inward direction when the fascia member 40 is securely and interlockingly installed on the dam member 20 with the spring clip member 50 interposed therebetween. This resilient biasing force further results in a reactive force on the first sloping portion 54 of the spring clip member 50 in a generally downward and outward direction, biasing the first sloping portion 54 against the sloping dam portion 30 in order to frictionally anchor, compress and secure the roofing material 70 between the spring clip member 50 and the dam member 20 when the fascia member 40 is installed. Also, because of the resiliency of the spring clip member 50, the lower dam edge portion 26 preferably exerts a biasing force on the lower channel portion 44 of the fascia member 40 in a generally downward and inward direction when the fascia member 40 is installed. In addition to the above, the above mentioned biasing forces on the concave upper portion 46 and on the lower portion 44 of the fascia member 40 result in a generally inwardly-directed force being exerted on the vertical fascia portion 42 when the fascia member 40 is installed. Preferably, such inwardly-directed force on the vertical fascia portion 42 forcibly biases the vertical spring clip portion 52 in an inward direction in order to frictionally anchor, compress and secure the roofing material 70 between the vertical spring clip portion 52 and the vertical dam portion 22. Therefore, as can readily be appreciated from the above discussion and the drawings, the interposition of the spring clip member 50 between the fascia member 40 and the dam member 20 provides a very positive and secure anchoring of the roofing material 70 beteen the spring clip member 50 and the dam member 20, as well as providing for a relatively tight, rattle-free and secure installation of the fascia member 40 on the remainder of the raised roof edge assembly 10.

Figure 5:
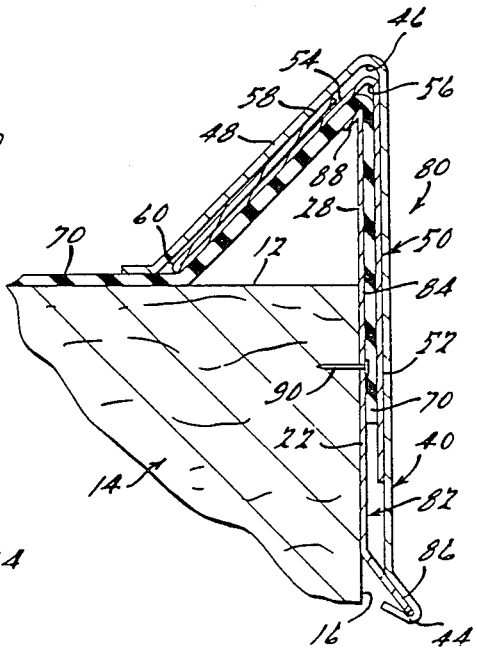
FIG. 5 is a cross-sectional view similar to that of FIG. 2, but illustrating another embodiment of a roof edge assembly according to the present invention.

FIG. 5 illustrates an alternate embodiment of the invention, wherein a raised roof edge assembly 80 is generally similar to the raised roof edge assembly 10 shown in FIGS. 1 through 4, with the exception of the provision of an alternate dam member 82. Since the remaining components of the alternate raised roof edge assembly 80 are substantially similar to the corresponding components of the raised roof edge assembly 10, the same reference numerals are used to indicate such similar corresponding components in the roof edge assembly 10 and in the roof edge assembly 80.

The alternate dam member 82 shown in FIG. 5 is somewhat similar to the dam member 20 shown in FIGS. 1 through 4, except that the vertical dam portion 84 extends from a lower dam edge portion 86 to a preferably bent-over lip portion 88 located above the roof 12, generally at the top of the vertical dam portion 84. One or more fasteners 90 are used to secure the vertical dam portion 84 to the outer face 16 of the building structure 14. When the spring clip member 50 and the fascia member 40 are installed on the dam member 82, with the roofing material 70 interposed between the spring clip member 50 and the dam member 82, the lower spring clip edge portion 60 holds the roofing material 70 against the roof 12 in a manner similar to that in which the lower spring clip edge portion 60 holds the roofing material 70 against the dam member 20 and the roof 12 in the above-described raised roof edge assembly 10. Furthermore, the interlocking installation of the fascia member 40 on the remainder of the alternate raised roof edge assembly 80 also causes the spring clip member 50 to resiliently bias the roofing material 70 against the roof 12 and the vertical dam portion 84 by way of reactive forces generally similar to those discussed above in connection with the raised roof edge assembly 10.

Figure 6:
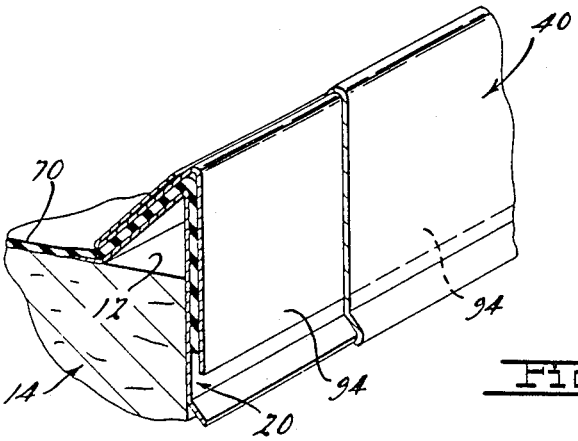
FIG. 6 is a perspective view similar to that of FIG. 1, but illustrating a further variation on the present invention having a generally continuous spring clip member.

Although a number of spring clip members 50 are provided at predetermined spaced-apart locations along the raised roof edge assembly 10 shown in FIG. 1, an alternate configuration of the alternate spring clip member 94 shown in FIG. 6 can also be provided. Such alternate spring clip member 94 can have the same cross-sectional configuration as spring clip member 50, or even the alternate cross-sectional configuration shown in FIG. 7 discussed below, and is generally continuous and co-extensive with generally straight portions of either the raised roof edge assembly 10 or the alternate raised roof edge assembly 80, in lieu of the discrete, spaced-apart spring clip members 50 shown in FIG. 1.

Figure 7:
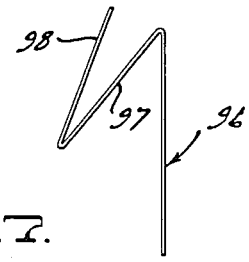
FIG. 7 is a cross-sectional view of another embodiment of the spring clip member according to the present invention.
Figure 12:
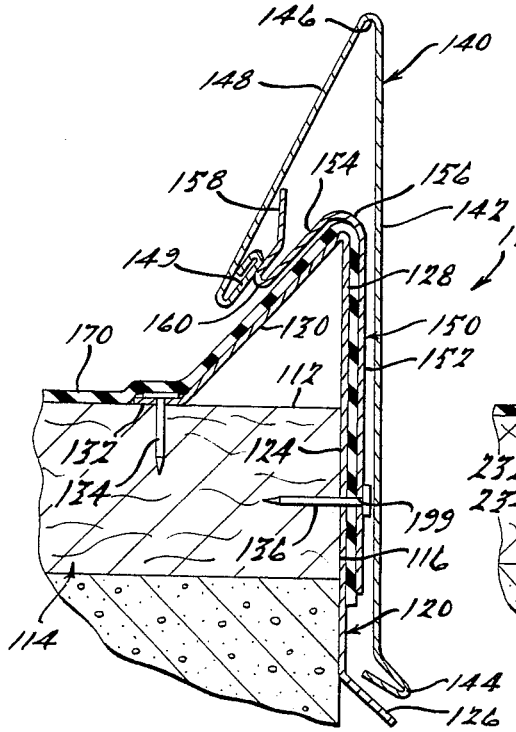
FIG. 12 is a cross-sectional view similar to FIG. 10, but illustrating the fascia member being installed on the remainder of the roof edge assembly.

FIG. 7 illustrates still another alternate spring clip member 96, which can be employed with any of the embodiments of the invention described herein. The alternate spring clip member 96 has a first sloping portion 97 and a second sloping portion 98 that intersect at their respective lower edges to form a generally acute angle therebetween. Such a configuration eliminates the flattened configuration of the lower spring clip edge portion 60 of the spring clip members 50 and 94. The configuration of the alternate spring clip member 96, which can be advantageously employed where the spring clip member is formed of a particularly thick material or other material that presents difficulties in forming by bending, functions in a manner similar to that described above to frictionally and grippingly anchor, compress and secure the roofing material 70.

Figure 8:
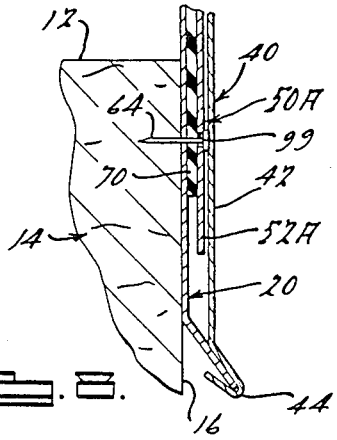
FIG. 8 is a partial cross-sectional view of still another optional construction of the spring clip member according to the present invention.

FIG. 8 illustrates another optional construction according to the present invention in an alternate spring clip member 50A. It should be noted that the construction shown in FIG. 8 can optionally be employed in any or all of the other embodiments of the invention shown in FIGS. 1 through 7 and discussed above.

The optional alternate spring clip member 50A has an aperture 99 extending through its vertical spring clip portion 52A for receiving the optional fastener 64 extending therethrough, as well as through the roofing material 70 and into the outer face 16 of the building structure 14. In this construction, the roofing material 70 is anchored to the outer face 16 both by the frictional and gripping engagement of the spring clip 50A and the fascia member 42 and by the fastener 64 in applications wherein it is desirable to even more securely anchor the roofing material 70 to the building structure. Furthermore, in this arrangement, the spring clip functions as a washer-like bearing member in order to securely grip and engage the roofing material 70 and substantially prevent it from tearing in the area adjacent the point of penetration by the fastener 64. It should be noted that the opening 99 can be a hole or aperture of virtually any desired shape, including an elongated slot-like opening to provide some degree of flexibility in the position of the fastener 64. In addition, it should be noted that the optional fastener 64 can be used either in conjunction with, or instead of, the above-described fastener 36.

FIGS. 9 through 17 illustrate other illustrative embodiments of the present invention, which are generally similar to those shown and discussed above in connection with FIGS. 1 through 8, with certain exceptions noted below. Because many of the components illustrated in FIGS. 9 through 17 are generally similar or identical in configuration or function with those of the embodiments of FIGS. 1 through 8 (with various exceptions discussed below), such components of FIGS. 9 through 17 are indicated by reference numerals that are similar to those of the corresponding components of FIGS. 1 through 8, but that have one-hundred prefixes in FIGS. 9 through 12 and 14, two-hundred prefixes in FIG. 13, three-hundred prefixes in FIGS. 15 and 16, and four-hundred prefixes in FIG. 17, respectively.

In FIGS. 1 through 12, the preferred fascia member 140 is generally similar to the fascia member 40 described above, except that an inner portion 149 protrudes or extends into the interior of the generally concave upper portion 146, preferably from an area generally adjacent the lower edge of the sloping fascia portion 148. The inner portion 149 releasably and interlocking engages the lower clip edge portion 160 in a generally resilient "snapped-on" relationship therewith, with the sloping fascia portion 148 extending downwardly toward the roof 112 to retain and provide weather protection for the roofing material 170, in a manner generally similar to that illustrated in FIGS. 1 through 8. Such an arrangement provides for a convenient and easy installation of the fascia member 140 on the remainder of the roof edge assembly 110, while also providing for an enhanced positive interlocking installation to substantially prevent or resist any tendency of the fascia member 140 to be removed or become loose as a result of the forces of wind, water, or other elements exerted on the roof edge assembly 110.

The fastener 136 in FIGS. 1 through 12 is shown as extending through the opening 199 in the clip member 150, the roofing material 170, the dam member 120, and into the building structure 114, in order to securely attach the clip member 150 and the roofing material 170 to the outer face 116 of the building structure 114. However, as one skilled in the art will readily recognize, the fastener 136 can alternately be arranged to extend through the dam member 120, in a manner similar to that illustrated in connection with FIG. 13, discussed below. In this regard, one skilled in the art will also readily recognize that the clip member 150, like the spring clip member 50 shown in FIGS. 1 through 8, can be composed of a resilient spring material, such as spring steel sheet, for example, in order to provide the resilient deflection of the second sloping portion 158 of the clip member 150, and the resultant reactive resilient biasing forces, in a manner similar to that described above in connection with FIGS. 1 through 8.

Figure 13:
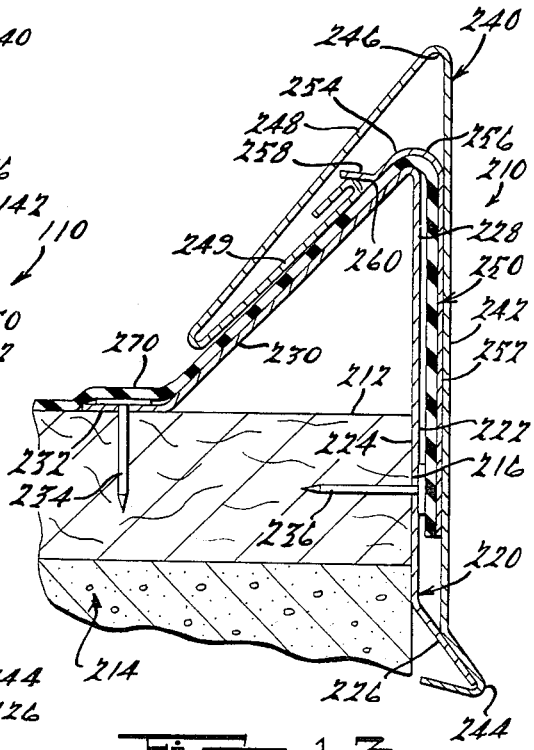
FIG. 13 is a cross-sectional view similar to that of FIG. 10, but illustrating a further embodiment of a roof edge assembly according to the present invention.
Figure 14:
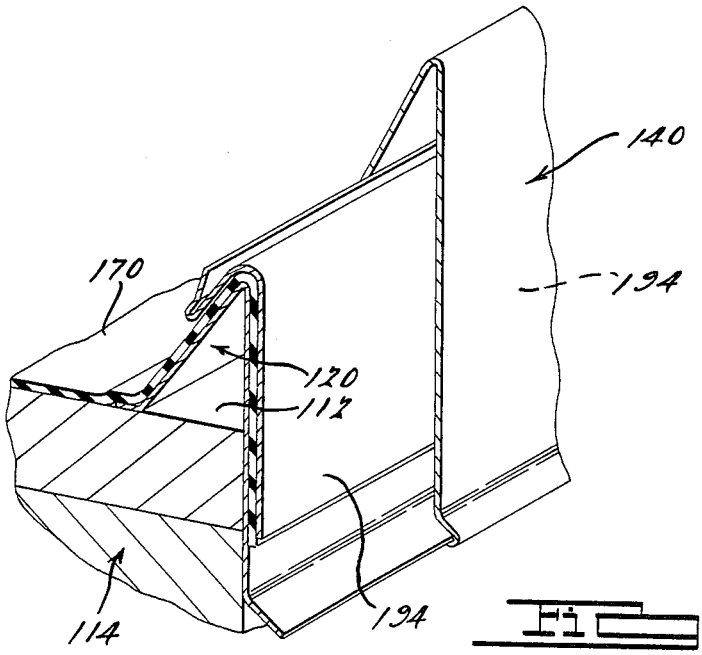
FIG. 14 is a cross-sectional view illustrating a further variation on the present invention having a generally continuous clip member.

FIG. 13 illustrates the manner in which the fascia member 140 is interlockingly installed on the remainder of the raised roof assembly 110. Once the dam member 120 is securely attached to the building structure 114, and the roofing material 170 is properly positioned in an overlapping engagement on the dam member 120, the clip member 50 is positioned over the roofing material 170 and the dam member 120. The concave upper portion 146 of the fascia member 140 is placed over the clip member 150 and urged downwardly so as to partially deflect or collapse at least the second sloping portion 158 of the clip member 150 in a direction generally away from the sloping fascia portion 148. Such deflection of the second sloping clip portion 158 occurs substantially simultaneously with a spring-like "snapping" engagement of the inner portion 149 with the lower clip edge portion 160 and also allows the lower channel portion 144 of the fascia member 140 to clear the lower dam edge portion 126. Because of the resilient deflection discussed above, and an accompanying resilient deflection of the sloping fascia portion 148, the fascia member 140 can then be released, causing the fascia member 140 to spring or snap upwardly such that the lower channel portion 144 interlockingly receives the lower dam edge portion 126 and is interlockingly captured thereon.

FIG. 13 illustrates another variation on the present invention, wherein the clip member 150 is replaced by a clip member 250 having a first sloping portion 254 and a protrusion 258 protruding or extending from the lower clip edge portion 260 in a direction transverse to the first sloping portion 254. The fascia member 240 in FIG. 13 includes an inner portion 249 that is generally similar to the inner portion 149 of the previously-described fascia member 140, but adapted to releasably and interlockingly engage the protrusion 258 on the lower clip edge portion 260 in a resilient "snapped-on" relationship therewith. In this regard, it should be noted that although the second sloping portion 158 shown in FIGS. 9 through 12 extends generally upwardly and outwardly once the fascia member 140 is securely installed, and although the protrusion 258 in FIG. 13 extends in a generally upwardly and inwardly direction, such protrusions or corresponding sloping portions of the clip members according to the present invention can also optionally extend in other directions that are transverse to the sloping portions of such clip members. Further in this regard, although it is preferred that the clip member 250 is also composed of a material that is somewhat resilient and deflectable in order to accommodate the snap-on installation of the fascia member 240, the clip member 250 can be substantially more rigid than the clip member 150 discussed above since the protrusion 258 does not necessarily need to be resiliently deflected during installation of the fascia member 240 as much as does the second sloping portion 158 of the clip member 150 shown in FIGS. 9 through 12. In other respects, however, the installation, function, and configuration of the various components of the embodiment shown in FIG. 13 are generally similar to those of the corresponding components of the embodiment shown in FIGS. 1 through 12.

It should be emphasized that in any of the embodiments shown in FIGS. 9 through 14, the inner portions 149 or 249 of the respective fascia members 140 or 240 also serve to resiliently engage and anchor the roofing material 170 or 270 against the respective dam members 120 or 240.

Although a number of clip members 150 or 250 are provided at predetermined spaced-apart locations along the respective raised roof edge assemblies 110 or 220 shown in FIGS. 9 through 13, an alternate configuration of an alternate clip member 194 (shown in FIG. 14) can have the same cross-sectional configuration as the clip member 150 or the alternate cross-sectional configuration of the clip member 250, and is generally continuous and co-extensive with generally straight runs or sections of the raised roof edge assemblies 110 or 210, in lieu of the discrete, spaced-apart clip members 150 and 250 shown in FIGS. 9 through 13.

FIGS. 15 and 16 illustrate still another of the preferred embodiments of the present invention, wherein a clip member 350, which is somewhat different from the clip members described in the previously-discussed embodiments, is interposed between the sloping fascia portion 348 and the sloping dam portion 330. The clip member 350 includes a lower clip edge portion 360, a discontinuity 362, which is preferably of a generally arcuate concave configuration, and a clip flange portion 366. The lower clip edge portion 360 and the clip flange portion 366 are disposed generally adjacent the clip discontinuity 362, on opposite sides thereof. Because the clip member 350 is preferably composed of a resiliently deflectable material, the clip discontinuity 362 is resiliently compressed or deflected in a generally downward and outward direction between the sloping fascia portion 348 and the sloping dam portion 330, as shown in FIG. 15, when the fascia member 340 is installed on the dam member 320 with the clip member 350 interposed therebetween.

As a result of the above-discussed resilient compression or deflection of at least a portion of the clip member 350 between the sloping fascia portion 348 and the sloping dam portion 330, the fascia member 340 is resiliently biased in a generally upward and inward direction in order to securely engage the fascia member 340 with the dam member 330. In this regard, it should be noted that the angular relationship of the sloping fascia portion 348 with the vertical fascia portion 342, along with the resiliency or spring constant of the clip member 350, can be varied in accordance with the design parameters in a particular application. Thus, depending upon such angular relationship and the spring constant of the clip member 350, the clip discontinuity 362 can be only partially collapsed or compressed when the fascia member 340 is installed on the dam member 320, leaving a spaced, angular relationship between the sloping fascia portion 348 and the sloping dam portion 330, or the clip discontinuity 362 can be totally collapsed into a generally flat configuration, with the sloping fascia portion 348 lying in a generally parallel and generally confronting relationship with the sloping dam portion 330. In either event, the inner portion 349 of the fascia member 340 is interlockingly engaged with the lower clip edge portion 360, and the resilient reactive forces of the resiliently deflected clip member 350 serve to grippingly anchor the roofing material 370 between the sloping fascia portion 348 and the sloping dam portion 330.

Furthermore, it should be noted that depending upon the objectives and design parameters in a particular installation, the roofing material 370 can extend over the upper dam portion 328 and along the vertical dam portion 322, or can be terminated generally at the upper end of the sloping dam portion 330. Similarly, the fastener 336 can optionally extend through the roofing material 370, in applications where the roofing material 370 extends along the vertical dam portion 322, as well as extending through the vertical dam portion 322, as mentioned above in connection with the various embodiments of the present invention disclosed herein.

FIG. 17 illustrates still another embodiment of the present invention, which represents a variation on the embodiment discussed above and shown in FIGS. 15 and 16. In the embodiment shown in FIG. 17, the clip member 450 is provided with a generally hooked end 468 located generally adjacent the lower clip edge portion 460. Correspondingly, the inner portion 449 adjacent the sloping fascia portion 448 is also equipped with a generally hooked end 451. Thus, when the fascia member is installed on the dam member, with the clip member 450 interposed therebetween, the hooked end 468 of the clip member 450 is interlocking engageable with the hooked end 451 on the inner fascia portion 449 in order to securely install the fascia member on the remainder of the roof edge assembly and to assure proper resilient compression or deflection of the clip member 450 and the resultant gripping engagement of the roofing material 470.

The foregoing discussion discloses and describes exemplary embodiments of the present invention. One skilled in the art will readily recognize from such discussion that various changes, modifications, and variations may be made therein without departing from the spirit and scope of the invention as defined in the following claims.

What is claimed is:

1. An assembly for forming a raised roof edge on a building structure having a generally horizontal roof and a generally vertical outer face, said assembly comprising:

a dam member having a generally vertical dam portion with an inwardly directed face for confronting the outer face of the building structure, said generally vertical dam portion further having an upper dam portion and a lower dam edge portion, said dam member including a sloping dam portion extending generally downwardly and inwardly generally from said upper dam portion, and attachment means for attaching said generally vertical dam portion to the outer face of the building structure with said upper dam portion protruding upwardly above the roof of the building structure;

a fascia member installable on said dam member and having a generally concave upper portion for receiving said upper dam portion therein and a lower channel portion for receiving said lower dam edge portion therein when said fascia member is installed on said dam member, said fascia member also having an inner portion extending generally into said concave upper portion; and a clip member for interposition between said fascia member and said dam member when said fascia member is installed thereon, said clip member having a lower clip edge portion interlockingly engaging said inner portion of said fascia member when said fascia member is installed on said dam member with said clip member interposed therebetween.

2. An assembly according to claim 1, wherein said clip member includes a discontinuity generally adjacent said lower clip edge portion, at least said clip discontinuity being resiliently deflectable in a generally downward and outward direction toward said sloping fascia portion when said fascia member is installed on said dam member with said clip member interposed between said fascia member and said dam member in order to resiliently bias said fascia member in a generally upward and inward direction toward said dam member.

3. An assembly according to claim 2, further comprising attachment means for attaching said sloping dam portion to the roof of the building structure generally at a lower edge portion of said sloping dam portion.

4. An assembly according to claim 1, further comprising roofing material overlappingly engaging at least a portion of said dam member and being anchored between said clip member and said dam member when said fascia member is installed on said dam member with said clip member interposed therebetween.

5. An assembly according to claim 1, wherein said dam member and said fascia member are generally horizontally elongated for generally horizontal installation along the roof edge, said assembly including a number of said clip members interposed between said dam member and said fascia member at predetermined horizontally spaced apart locations.

6. An assembly according to claim 1, wherein said dam member and said fascia member are generally horizontally elongated for generally horizontal installation along the roof edge, said clip member also being generally horizontally elongated and generally horizontally continuous with said dam member and fascia member.

7. An assembly according to claim 2, wherein said clip member is interposed between said sloping fascia portion and said sloping dam portion, and said clip discontinuity is generally concave in a generally downward and outward direction when said clip member is interposed between said sloping fascia portion and said sloping dam portion.

8. An assembly according to claim 7, wherein said clip member further includes a clip flange portion generally adjacent said clip discontinuity on an opposite side thereof from said lower clip edge, said clip flange engaging said sloping fascia portion when said clip discontinuity is resiliently deflected between said sloping first portion and said sloping dam portion.

9. An assembly according to claim 7, wherein said clip member further includes a hooked end generally adjacent said lower clip edge portion, said inner portion of said fascia member also having a hooked end thereon, said hooked ends of said clip member and said fascia inner portion being interlockingly engageable with one another when said fascia member is installed on said dam member with said clip member interposed therebetween.

10. An assembly according to claim 7, wherein said generally concave clip discontinuity is generally arcuate in configuration.

11. An assembly for forming a raised roof edge on a building structure having a generally horizontal roof and a generally vertical outer face, said assembly comprising:

a dam member having a generally vertical dam portion with an inwardly directed face for confronting the outer face of the building structure, said generally vertical dam portion further having an upper dam portion and a lower dam edge portion, said dam member including a sloping dam portion extending generally downwardly and inwardly generally from said upper dam portion, and attachment means for attaching said generally vertical dam portion to the outer face of the building structure with said upper dam portion protruding upwardly above the roof of the building structure;

a fascia member installable on said dam member and having a generally concave upper portion for receiving said upper dam portion therein and a lower channel portion for receiving said lower dam edge portion therein when said fascia member is installed on said dam member, said fascia member also having an inner portion extending generally into said concave upper portion; and a clip member for interposition between said fascia member and said dam member when said fascia member is installed thereon, said clip member having a generally vertical clip portion positionable in a generally confronting relationship with said generally vertical dam portion, a first sloping clip portion extending generally downwardly and inwardly generally from said vertical clip portion when said clip member is positioned on said dam member, said clip member further having a lower clip edge portion on said first sloping clip portion, and a clip protrusion extending generally transversely from said first sloping clip portion, said clip protrusion interlockingly engaging said inner portion of said fascia member when said fascia member is installed on said dam member with said clip member interposed therebetween, said first sloping portion of said clip member confronting said sloping dam portion when said fascia member is installed on said dam member with said clip member interposed between said fascia member and said dam member.

12. An assembly according to claim 11, wherein said clip protrusion comprises a second sloping clip portion extending generally upwardly from a position on said second sloping clip portion generally adjacent said lower clip edge portion, at least said second sloping clip portion being resiliently deflectable in a generally downward and outward direction toward said first sloping clip portion when said fascia member is installed on said dam member with said clip member interposed therebetween.

13. An assembly according to claim 12, further comprising attachment means for attaching said sloping dam portion of the roof of the building structure generally at a lower edge portion of said sloping dam portion.

14. An assembly according to claim 11, further comprising roofing material overlappingly engaging said dam member and being anchored between said clip member and said dam member at least when said fascia member is installed on said dam member with said clip member interposed therebetween.

15. An assembly according to claim 14, wherein said roofing material overlappingly engages said upper dam portion and said vertical dam portion.

16. An assembly according to claim 15, further comprising attachment means for attaching said generally vertical clip portion to the outer face of the building structure with said vertical dam portion therebetween, said attachment means extending through an opening in said vertical clip portion, through said roofing material and said vertical dam portion, and into said building structure, said vertical clip portion acting as a washer-like structure to substantially prevent tearing of said roofing material adjacent said attachment means.

17. An assembly according to claim 16, wherein said opening in said vertical clip portion is an elongated opening.

18. An assembly according to claim 11, wherein said dam member and said fascia member are generally horizontally elongated for generally horizontal installation along the roof edge, said assembly including a number of said clip members interposed between said dam member and said fascia member at predetermined horizontally spaced apart locations.

19. An assembly according to claim 11, wherein said dam member and said fascia member are generally horizontally elongated for generally horizontal installation along the roof edge, said clip member also being generally horizontally elongated and generally horizontally continuous with said dam member and fascia member.

20. An assembly according to claim 11, further comprising attachment means for attaching said generally vertical clip portion to the outer face of the building structure with said vertical dam portion therebetween.

21. An assembly for forming a raised roof edge on a building structure having a generally horizontal roof and a generally vertical outer face, said assembly comprising:

a dam member having a generally vertical dam portion with an inwardly directed face positionable in a generally confronting relationship with the outer face of the building structure, said vertical dam portion extending generally upwardly from a lower dam edge portion to an upper dam portion above the roof of the building structure when said vertical dam portion is positioned in said confronting relationship with the outer face of the building structure, said dam member further including a sloping dam portion extending generally downwardly and inwardly from said upper dam portion to engage the roof of the building structure, and attachment means for attaching said generally vertical dam portion to the outer face of the building structure;

a fascia member securely installable on said dam member and having a concave upper portion for receiving said upper dam portion therein in an overlapping engagement with said sloping dam portion and a lower channel portion for receiving said lower dam edge portion therein when said fascia member is securingly installed on said dam member, said fascia member also having an inner portion extending generally into said concave upper portion; and a separate clip member for interposition between said fascia member and said dam member when said fascia member is securely installed thereon, said clip member having a generally vertical clip portion positionable in a confronting relationship with said generally vertical dam portion, and a first sloping clip portion extending generally downwardly and inwardly and confronting said sloping dam portion when said clip member is positioned on said dam member, said clip member further having a lower clip edge portion on said first sloping clip portion, and a clip protrusion extending generally transversely from said lower clip edge portion in order to form an acute angle with said first sloping clip portion, said clip protrusion interlocking engaging said inner portion of said fascia member and at least said second sloping clip portion being resiliently and pivotally deflectable relative to said lower clip edge portion generally toward said first sloping clip portion when said fascia member is securely installed on said dam member with said clip member interposed therebetween.

22. An assembly according to claim 21, further comprising attachment means for attaching said sloping dam portion to the roof of the building structure generally at the area of said engagement of said sloping dam portion with the roof.

23. An assembly according to claim 21, further comprising sheet like roofing material overlappingly engaging at least said sloping dam portion and being anchored between said clip member and said dam member at least when said fascia member is securingly installed on said dam member with said clip member interposed therebetween.

24. An assembly according to claim 23, wherein said roofing material overlappingly engages both said sloping dam portion and said vertical dam portion.

25. An assembly according to claim 24, further comprising attachment means for attaching said generally vertical clip portion to the outer face of the building structure with said vertical dam portion therebetween, said attachment means extending through an opening in said vertical clip portion, through said roofing material and said vertical dam portion, and into said building structure, said vertical clip portion acting as a washer-like structure to substantially prevent tearing of said roofing material adjacent said attachment means.

26. An assembly according to claim 25, wherein said opening in said vertical clip portion is an elongated opening.

27. An assembly according to claim 21, wherein said dam member and said fascia member are generally horizontally elongated for generally horizontal installation along the roof edge, said assembly including a member of said clip members interposed between said dam member and said fascia member at predetermined spaced apart locations.

28. An assembly according to claim 21, wherein said dam member and said fascia member are generally horizontally elongated for generally horizontal installation along the roof edge, said clip member also being generally horizontally elongated and generally horizontally continuous with said dam member and said fascia member.

29. An assembly according to claim 21, wherein said lower dam edge portion includes a flange portion extending generally downwardly and outwardly relative to said vertical dam portion, said flange portion being received in said lower channel portion of said fascia member when said fascia member is securingly installed in said dam member.

30. An assembly according to claim 21, wherein said clip member exerts a resilient biasing force on said concave upper portion of said fascia member in a generally upward and inward direction when said fascia member is securingly installed on said dam member with said clip member interposed therebetween, said resilient biasing force resulting in a reactive force on said first sloping clip portion in a generally downward and outward direction biasing said first sloping clip portion against said sloping dam portion.

31. An assembly according to claim 30, further comprising a sheet-like roofing material overlappingly engaging at least said sloping dam portion and being interposed between said sloping dam portion and first sloping clip portion of said clip member, said reactive force on said first sloping clip portion anchoring said roofing material between said clip member and said dam member when said fascia member is securingly installed on said dam member with said clip member interposed therebetween.

32. An assembly according to claim 31, wherein said lower dam edge portion exerts a biasing force on said lower channel portion of said fascia member in a generally downward and inward direction when said fascia member is securingly installed on said dam member with said clip member interposed therebetween.

33. An assembly according to claim 32, further comprising sheet-like roofing material overlappingly engaging both said sloping dam portion and said vertical dam portion further being interposed between said vertical dam portion and said vertical clip portion, said fascia member further including a generally vertical fascia portion between said concave upper portion and said lower channel portion, said biasing forces on said concave upper portion and on said lower channel portion of said fascia member resulting in a generally inward force on said vertical fascia portion when said fascia member is securingly installed on said dam member with said clip member interposed therebetween, said generally inward force on said vertical fascia portion also forcibly biasing said vertical clip portion generally inwardly in order to anchor said roofing material between said vertical clip portion and said vertical dam portion.

34. An assembly for forming a raised roof edge on a building structure having a generally horizontal roof and a generally vertical outer face, said assembly comprising:

a dam member having a generally vertical dam portion with an inwardly directed face positionable in a generally confronting relationship with the outer face of the building structure, said vertical dam portion extending generally upwardly from a lower dam edge portion to an upper dam portion above the roof of the building structure when said vertical dam portion is positioned in said confronting relationship with the outer face of the building structure, said dam member further including a sloping dam portion extending generally downwardly and inwardly from said upper dam portion to engage the roof of the building structure, and attachment means for attaching said generally vertical dam portion to the outer face of the building structure;

a fascia member securely installable on said dam member and having a concave upper portion for receiving said upper dam portion therein in an overlapping engagement with said sloping dam portion and a lower channel portion for receiving said lower dam edge portion therein when said fascia member is securingly installed on said dam member, said fascia member also having an inner portion extending generally into said concave upper portion; and a separate clip member for interposition between said fascia member and said dam member when said fascia member is securely installed thereon, said clip member having a generally vertical clip portion positionable in a confronting relationship with said generally vertical dam portion, and a first sloping clip portion extending generally downwardly and inwardly and confronting said sloping dam portion when said clip member is positioned on said dam member, said clip member further having a lower clip edge portion on said first sloping clip portion, and a clip protrusion extending generally transversely from said lower clip edge portion in order to form an obtuse angle with said first sloping clip portion, said clip protrusion interlockingly engaging said inner portion of said fascia member and at least said second sloping clip portion being resiliently and pivotally deflectable relative to said lower clip edge portion generally toward said first sloping clip portion when said fascia member is securely installed on said dam member with said clip member interposed therebetween.

35. An assembly according to claim 34, further comprising attachment means for attaching said sloping dam portion to the roof of the building structure generally at the area of said engagement of said sloping dam portion with the roof.

36. An assembly according to claim 34, further comprising sheet like roofing material overlappingly engaging at least said sloping dam portion and being anchored between said clip member and said dam member at least when said fascia member is securingly installed on said dam member with said clip member interposed therebetween.

37. An assembly according to claim 36, wherein said roofing material overlappingly engages both said sloping dam portion and said vertical dam portion.

38. An assembly according to claim 37, further comprising attachment means for attaching said generally vertical clip portion to the outer face of the building structure with said vertical dam portion therebetween, said attachment means extending through an opening in said vertical clip portion, through said roofing material and said vertical dam portion, and into said building structure, said vertical clip portion acting as a washer-like structure to substantially prevent tearing of said roofing material adjacent said attachment means.

39. An assembly according to claim 38, wherein said opening in said vertical clip portion is an elongated opening.

40. An assembly to claim 34, wherein said dam member and said fascia member are generally horizontally elongated for generally horizontal installation along the roof edge, said assembly including a number of said clip members interposed between said dam member and said fascia member at predetermined spaced apart locations.

41. An assembly according to claim 34, wherein said dam member and said fascia member are generally horizontally elongated for generally horizontal installation along the roof edge, said clip member also being generally horizontally elongated and generally horizontally continuous with said dam member and said fascia member.

42. An assembly according to claim 34, wherein said lower dam edge portion includes a flange portion extending generally downwardly and outwardly relative to said vertical dam portion, said flange portion being received in said lower channel portion of said fascia member when said fascia member is securingly installed on said dam member.

* * * * *

UNITED STATES PATENT AND TRADEMARK OFFICE

CERTIFICATE OF CORRECTION

PATENT NO. : 4,759,157

DATED : July 26, 1988

INVENTOR(S) : Russell Webb et al

It is certified that error appears in the above-identified patent and that said Letters Patent is hereby corrected as shown below:

ON THE TITLE PAGE, UNDER REFERENCES CITED:

Prior art listed as U.S. Patent Documents, p. 2 of the patent "3,477,273" should be --3,447,273--.

Prior art listed as U.S. Patent Documents, p. 2 of the patent "4,641,147" should be --4,641,476--.

Prior art listed as Foreign Patent Documents, p. 1 of the patent "of 1911" should be --3/1911--.

| | | |
|---|---|---|
| Column 1, | line 15, | "raise" should be --raised--. |
| Column 4, | line 28, | "overlapping" should be --overlappingly--. |
| Column 5, | line 46 | "cam" should be --dam--. |
| Column 6, | line 51, | "beteen" should be --between--. |
| Column 11, | line 17, | "interlocking" should be --interlockingly--. |

UNITED STATES PATENT AND TRADEMARK OFFICE

CERTIFICATE OF CORRECTION

PATENT NO. : 4,759,157

DATED : July 26, 1988

INVENTOR(S) : Russell Webb et al

It is certified that error appears in the above-identified patent and that said Letters Patent is hereby corrected as shown below:

| | | |
|---|---|---|
| Column 13, | line 43, | "of" 1st occurrence should be --to--. |
| Column 14, | lines 62-63, | "interlocking" should be --interlockingly--. |
| Column 15, | line 34, | "member" should be --number--. |
| Column 18, | line 10, | after "assembly" insert --according--. |

Signed and Sealed this

Thirty-first Day of January, 1989

*Attest:*

*Attesting Officer*

DONALD J. QUIGG

*Commissioner of Patents and Trademarks*